US006205725B1

(12) United States Patent
Butler

(10) Patent No.: US 6,205,725 B1
(45) Date of Patent: Mar. 27, 2001

(54) INTERLOCKING CORRUGATED PANEL WALL CAST IN-SITU

(76) Inventor: Michael Butler, 31078 Turner Rd., Fort Bragg, CA (US) 95437

( * ) Notice: Subject to any disclaimer, the term of this patent is extended or adjusted under 35 U.S.C. 154(b) by 0 days.

(21) Appl. No.: 09/201,741

(22) Filed: Dec. 1, 1998

Related U.S. Application Data

(63) Continuation-in-part of application No. 08/871,395, filed on Jun. 9, 1997, now Pat. No. 6,076,320, which is a continuation-in-part of application No. 08/818,497, filed on Mar. 14, 1997, now abandoned, which is a continuation-in-part of application No. 08/600,408, filed on Feb. 12, 1996, now Pat. No. 5,830,378, which is a continuation-in-part of application No. 08/398,356, filed on Mar. 3, 1995, now abandoned, which is a continuation-in-part of application No. 08/299,474, filed on Aug. 29, 1994, now Pat. No. 5,564,235.

(60) Provisional application No. 60/067,741, filed on Dec. 2, 1997.

(51) Int. Cl.[7] ..... E02D 27/32

(52) U.S. Cl. ..... 52/292; 52/293.3; 52/295; 52/783.11; 52/528; 52/537; 52/588.1; 52/630

(58) Field of Search ..... 52/DIG. 15, 783.11, 52/798.1, 292, 295, 293.1, 293.3, 450, 537, 528, 534, 588.1, 630, 658, 674, 715, 729.3, 169.12; 29/897.32

(56) References Cited

U.S. PATENT DOCUMENTS

| | | | | |
|---|---|---|---|---|
| 1,484,398 | * | 2/1924 | Kerber | 52/272 |
| 2,200,636 | * | 5/1940 | Palmer | 52/293.1 |
| 3,262,236 | * | 7/1966 | Poyer | 52/DIG. 15 |
| 3,820,295 | * | 6/1974 | Folley | 52/630 X |
| 4,263,762 | * | 4/1981 | Reed | 52/293.3 |
| 4,490,958 | * | 1/1985 | Lowe | 52/729.3 X |
| 4,656,797 | * | 4/1987 | Marquart | 52/169.12 |
| 4,843,793 | * | 7/1989 | Ayers | 52/169.12 |
| 5,165,213 | * | 11/1992 | Finch et al. | 52/588.1 |

FOREIGN PATENT DOCUMENTS

| | | | | |
|---|---|---|---|---|
| 688535 | * | 10/1966 | (BE) | 52/537 |

* cited by examiner

*Primary Examiner*—Laura A. Callo
(74) *Attorney, Agent, or Firm*—Bruce H. Johnsonbaugh

(57) ABSTRACT

An interlocking corrugated fluted panel for use in constructing a foundation wall for a building where a plurality of the panels are attached to a presupported building member and the panels hang downwardly into a foundation support opening. At the bottom portion of each fluted panel, the flutes extending outwardly from the building are cut along a bend line and the bottom portion of the panel is bent inwardly approximately 90°, the bent portion forming an anchorage when concrete is placed around the bottom of the panels. At the lower edge of each panel a cut flute is bent into either an interlocking male or female shape.

12 Claims, 2 Drawing Sheets

INTERLOCKING CORRUGATED PANEL WALL CAST IN-SITU

CROSS-REFERENCE TO RELATED APPLICATIONS

This application claims the benefit of Provisional Application Ser. No. 60/067,741 filed Dec. 2, 1997.

This application is also a continuation-in-part of application Ser. No. 08/871,395 filed Jun. 9, 1997 and entitled FOUNDATION FOR A MODULAR STRUCTURE, now U.S. Pat. No. 6,076,320; which was a continuation-in-part of patent application Ser. No. 08/818,497 filed Mar. 14, 1997 for FOUNDATION FLOOR CONSTRUCTION METHODS AND DEVICES, now abandoned.

BACKGROUND AND BRIEF SUMMARY OF THE INVENTION

The present invention concerns methods and devices for construction of permanent foundations and anchorage for presituated modular structures, such as mobile homes, modular housing, other proprietary systems, and conventional site-built construction, these methods and devices offering significant cost improvements over existing practices.

The present invention particularly concerns a pre-hung corrugated foundation wall panel that is cast-in-place with footing concrete, and has a simple, low-cost, and reliable interlocking feature connecting adjacent panels.

The present invention is an improvement to the manufacture of cast-in-situ foundation wall panels which saves manufacturing cost by using a simple, single cut and bend anchorage to in-situ concrete.

This invention improves the resulting panel by providing horizontal stiffness and straightening for the bottom portion of the panel without the attachment of any other element. The process which creates the panel anchorage to concrete also creates adjacent panel connecting elements.

This invention saves on foundation panel installation cost and improves quality by providing reliable secure attachment of adjacent panels using just the panels themselves.

The degree of reliability and security to this adjacent panel attachment came as a genuine surprise to the inventor, with the ramification that this type of attachment can be successfully utilized for adjacent corrugated panels not having anything to do with foundation walls.

The example of panel anchorage and interconnection described here is but a specific embodiment of the idea of bending the panel bottom portion and using some of that material to interconnect adjacent panels. The interconnection can be made by simply crimping or twisting together the free material at each end of the anchorage element, for example. Or the excess material can be fashioned to wedge one appendage behind another in other configurations not shown here, as another example.

The object of this invention is to:

(1) Provide a structural, interlockable foundation wall panel, which can be pre-hung from a modular structure, floor framing grid or the like, and then have its lower edge cast with in-situ concrete to permanently provide support and anchorage. With this method, the presence of the modular structure is utilized optimally to define the foundation geometry, and to hold structural elements in place until in-situ concrete affixes those elements permanently.

(2) Provide a means of utilizing readily available decking panels, having normal factory straight-cut ends, for a new use as interlocking, multi-sectional foundation walls. These foundation walls can be weight bearing panels, shear panels, or combination bearing and shear panels, without the need for any other foundation wall framing members or like structure for those same foundation walls.

(3) Provide an anchorage design of the panels where a simple cut and bend process provides anchorage, horizontal straightening of panel bottoms, and interlocking mechanism between panels.

DETAILED DESCRIPTION OF THE DRAWINGS

Figure 1:
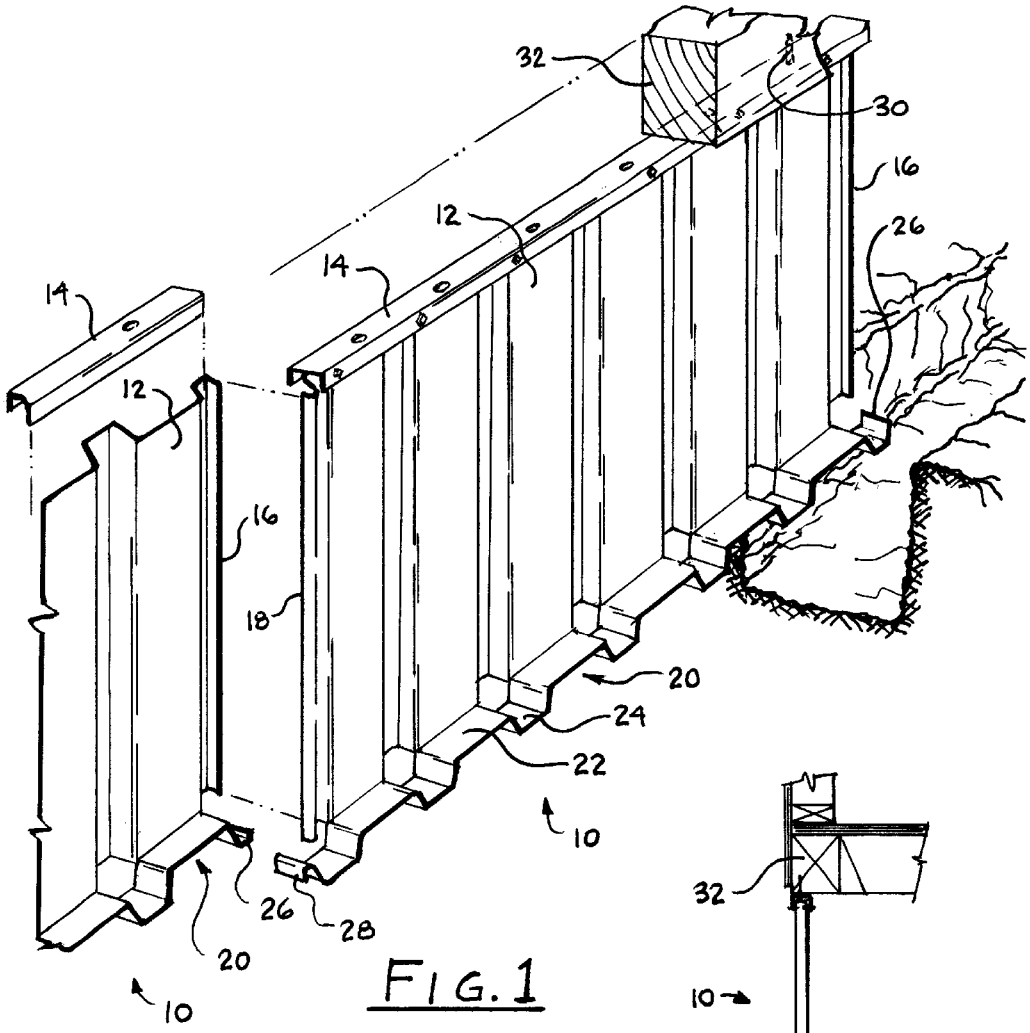
FIG. 1 is a view of foundation wall panels from foundation interior.

Commencing in the drawings, FIG. 1 is a view of a perimeter meter foundation panel assembly 10 shown from the interior side of a crawl-space foundation in progress.

Panel 10 is of a corrugated panel length 12 with a connecting cap 14 attached along the top edge. Panel 12 is a common galvanized steel corrugated panel such as those commonly used for roof decking or floor decking in building construction.

The particular panel shown is a "B36" model roof decking panel made by VERCO Corporation of 38 mm (1.5") corrugation thickness.

Most any corrugated panel design which is adequate for the imposed loads will serve the purpose of this perimeter foundation structural wall panel, without the presence of any other foundational structure such as ponywall framing, if the flutes are oriented vertically as shown. Also, the panels can be of another material, such as plastic or cement panel, so long as foundation structural requirements are satisfied. Presently, panel 12 is structurally most cost efficient if of steel, and so the detail of the panel anchorage is disclosed for commonly available steel panels.

Each panel 10 is attached to a perimeter of a structure above 32, which has been pre-situated in some manner. Perimeter 32 can be the lower perimeter surface of any pre-situated object, such as a modular structure, mobile home, proprietary floor grid, or any other object that physically defines the geometry of a building perimeter, where that geometry can be exploited directly to physically define the perimeter of a foundation.

Cap 14, bent of 1.44 mm (16 gage) galvanized steel, is just one example of a means to connect panel 12 to perimeter 32, by providing both a bearing surface and shear transfer. Cap can be factory or field attached to panel 12, and then panel assembly 10 is attached to perimeter through holes in cap. Cap can have many other profile configurations to suit uplift requirements, et cetera.

For modular housing units imposing significant gravity loads as well as lateral loads, steel panel 12 is typically of a thickness of about 1.44 mm (16 gage) or 1.14 mm (18 gage) material. For mobile homes that are primarily supported along the interior chassis, panel 12 at the perimeter would then be subject primarily to lateral loads with generally relatively small gravity loads. It could then be as light as about 0.720 mm (22 gage), depending on specific lateral load, any soil retaining forces, and geometry factors.

Galvanizing on steel panel 12 should preferably be a "G90" treatment due to the potentially damp environment in use. Subsequent surface treatment prior to any soil backfill is warranted for increased longevity for many soil types. Satisfactory and low cost treatment is a cement based coating such as a stucco "color coat," or a water-emulsified coal tar or asphalt product.

Panel 10 is best made in incremental heights (lengths) to suit specific project requirements, starting with a practical minimum height of about 300 mm (12"). Individual panel width is not crucial, it can be the industry standard for roof panels of 900 mm (36"), thus providing the benefits of conformity with presently available material. The shear connections between adjacent panels can also be state of the art.

The bottom of panel 10 is shaped to connect well to the in-situ concrete. An anchorage strip 20 is fabricated by first a horizontal cut to all ribs on one side of the panel, and then a horizontal bend to the remaining flutes at the location of the cut. This is shown with the cuts to the outer ribs with the advantage being that an inward bend is less obtrusive to reinforcing and concrete placement for reasons described in operation below, but strip 20 can bend inward or outward. Strip 20 forms an angle with panel 10 of preferably 90°, although angles of 45° to 135° will function.

The cut shown in the drawings is a simple slot, which can be punched or cut, but it can be any punched shape that takes out the entire girth of the ribs so that the bend can be made. A punched shape which takes out more rib material has a benefit of allowing more concrete to be contained about the anchorage elements of strip 20 described below.

Once bent to approximately perpendicular to panel 10, strip 20 provides horizontal stiffness to lower portion of panel 10. Original manufacture of panels 12 often results in curvature transverse to the ribs, and strip 20 provides stiffness by mitigating this curvature, and allowing complete correction of it by subsequent adjustment to panel out of plane.

Strip 20 has a series of a bearing tab 22 adjacent to each bend and an anchorage tab 24 adjacent to each cut. Bearing tab 22 is directly adjacent to panel bend and is higher in the concrete footing for higher weight bearing strength. Anchorage tab 24 is deeper in the concrete, yet retains tensile strength, for higher anchorage strength. The distinctions "bearing" and "anchorage" are simply made to describe what those elements perform best. Both elements serve both functions to various degrees.

Panel 12 is the most common decking type having male/female edge connections. Thus, interlocking feature, described below, of panel 10 is shown for interlocking type panels, yet the same fabrication to simple overlapping panels produces essentially the same results where at least one entire rib is overlapped.

A male edge 16 of panel 12 translates into a male leg 26 of strip 20. A female edge 18 of panel 12 translates into a female leg 28 of strip 20. These elements are described in detail in FIG. 3.

Common panel edge crimp connections, such as a "button punch" can be utilized at panel joints, but preferable field practice is to leave joints uncrimped because of access difficulties and proof performance of crimping tools on freely hanging, vertically oriented panels. Preferable field practice is to simply glue panels together at male/female edges with common construction adhesive or urethane adhesive caulk. As a benefit, this practice seals panel joints and ungalvanized edges while also providing shear transfer and good connection for the substrate of any subsequent surface coatings. With this practice, however, the adjacent panels must be physically connected at the bottom while such adhesive cures, and a simple elegant solution to this need is described below.

Figure 2:
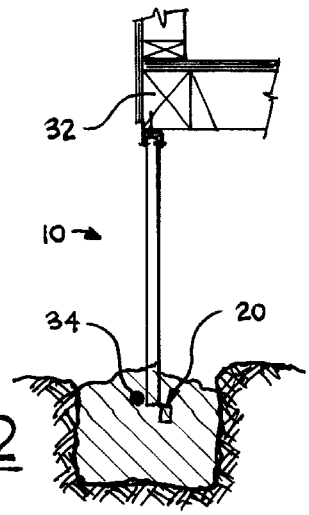
FIG. 2 is a section of installed panel with footing concrete placed.

In FIG. 2, panel 10 is shown in section view with in-situ footing concrete placed. In other words, this is an example of a typical construction detail provided to those involved in a project utilizing this type of a perimeter foundation.

Note that in-situ concrete is shown to be at about 50 mm over bearing tab 22 and so about 90 mm over anchor tab 24. These depths can vary to suit specific uplift requirements. Likewise the clearance between panel 10 and trench bottom can vary to suit bearing load requirements.

Width of strip 20 can be that to suit anchorage requirements to in-situ concrete and anticipated trench clearances. A width of about 35 mm is appropriate for light construction. A length of rebar 34, shown in section, can be utilized to align and true many adjacent sections of panel 10. Connection of rebar 34 to panel can be by any means, including the punching of holes allowing tie or cinch connections to be at appropriate intervals, such as one tie per panel.

Figure 3:
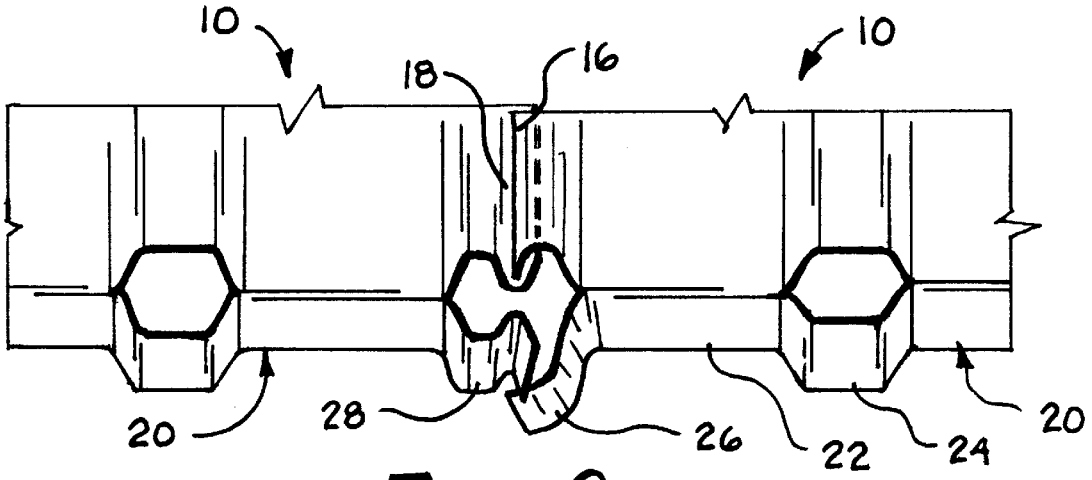
FIG. 3 is a detailed view of connection at the bottom of adjacent panels.

FIG. 3 is a detailed view of a bottom connection at adjacent panels. During fabrication of panel 10 and after strip 20 is bent, male leg 26 is individually bent so as to fit just behind female leg 28. This bend must be made so that leg 26 provides adjacent overlap behind leg 28, yet leg 26 can get by leg 28, as described below.

For prototype panels 10, this leg 26 bend is made repeatable by attaching a pointing device to a bending device whereby the pointing device references to another point on the panel, such as the lowest corner of the male edge 16. In other words, a "vice-grip" is clamped in a repeatable fashion to leg 26 and is manipulated so that a pointer of predetermined geometry is made to stop right at the lowest corner of male edge 16. This type of a tool provides an easy means of making a consistent repeatable bend to leg 26 even in the field.

Factory bends of leg 26 can be made by any state of the art fashion.

When adjacent panels are attached by overlap of leg 26 behind leg 28, panel male edge 16 is locked into female edge 18, thus, keeping adjacent panels securely attached during placement of in-situ concrete. Leg 26 and leg 28 take care of out of plane forces and keep male edge 16 into female edge 18, so those elements can take care of in place forces.

For adjacent panels which overlap rather than have male/female edges, leg 26' and leg 28' behave the same, and the overlap of at least one rib behaves the same as the combination of edge 16 and edge 18. The difference being that the male and female designations would reverse.

Operation

This foundation method varies according to conditions of support during and after structure installation. Also, the foundation panel necessary strength and weight requirements will change according to types and amounts of superimposed loads, and will change to a lesser degree according to panel height.

Mobile homes generally support most all of their weight via the main longitudinal beams. Thus, the perimeter panels can be lighter weight and generally are preferably installed after all permanent interior supports and plumbing connections, etc., have been completed.

Keeping in mind that sequence can vary, this method would typically be as follows for a "mobile home" having primary longitudinal beams clear of the perimeter:

(1) Prepare grade as required for interior and perimeter footings. Interior supports and footing design can be of any conventional of proprietary means. Trenching for the paneled perimeter can be very imprecise, so layout effort can be minimized.

(2) Place concrete for interior pier pads or treated-wood pier bases can be used.

(3) Place interior supports according to type used.

(4) Set mobile home section(s) in place and attach interior supports. Remove temporary supports and jacks, etc.

(5) Make utility connections, if preferable to do so now.

(6) Attach foundation panels around entire perimeter. Place rebar as required.

(7) Place perimeter footing concrete, preferably with a pump. Keep in mind that concrete must flow around the bottom of the panels and up over anchorage strip, so having a worker inside the crawl-space to verify concrete flow during this operation is beneficial. Panels are checked for plumb and adjusted, if necessary, while the concrete is still fluid.

(8) Treat panel exterior surface, if desired.

(9) Adjust site grades and backfill against panels as appropriate.

Continuing the operation, in FIGS. 2 and 3, the installation of any panel 10 is made via connections 30 at cap 14 into perimeter 32. Where access to place concrete is only from the exterior, the placement is preferably made with a concrete pump having a hose end small enough to easily direct in-situ footing concrete beneath panel bottoms. Please note that in FIG. 1 the trench geometry is shown behind the panels only.

Figure 4:
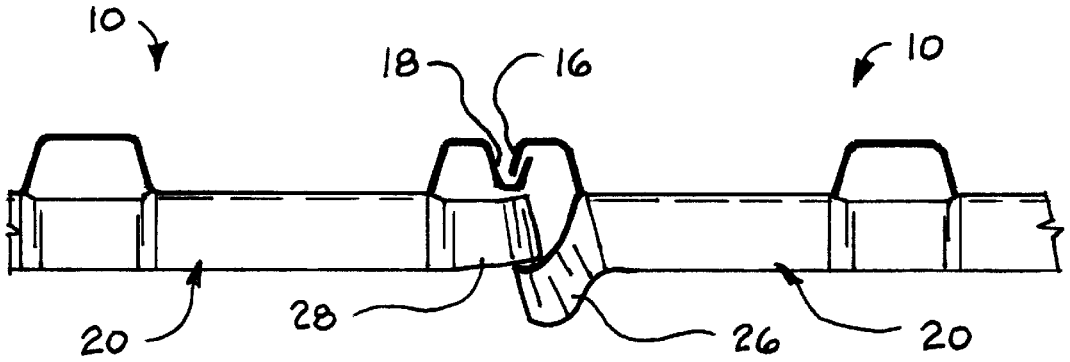
FIG. 4 is an upward view of panel bottom connection.

To go into more detail about adjacent panel connection, FIG. 4 is a view from the bottom. This shows important geometry of leg 26. The outermost edge of leg 26 is sloped so that male edge 16 of panel 10 with can be inserted straight into female edge 18 of adjacent panel 10. In other words, the sloped extreme edge allows leg 26 to get a start past leg 28, and then both legs flex while the legs are pushed by each other, until the keeping edge of leg 26 just clears leg 28, and both legs flex back into position, keeping adjacent panels interlocked.

Adjacent panels are attached more easily by attaching the adjacent edge first, while the plane of the panel being attached is rotated outward, the vertical axis along the male/female edges. With connecting portions beyond the effective hinge location, geometry of leg 28 and bent leg 26 is such that ample clearance is offered for interference free initial panel insertion, and then the legs close on each other as the panel is rotated into plane.

Where trench confinement does not allow enough rotation for the above method, a similar benefit is gained through rotation of a panel about a horizontal axis near legs 26,28.

The majority of the time, a combination vertical and horizontal rotation can be utilized about the legs, allowing good clearance and leverage in installation so that leg 26 can be production bent to fit tightly behind leg 28. For the case where a panel must be installed without beneficial rotation, such as the last edge of the last panel on a perimeter. This tighter bend of leg 26 may have to be field manipulated to latch behind leg 28.

Legs 26 and 28 may be connected or interlocked in other fashions. For example, rather than bending legs 26 and 28 into the male and female shapes described above, the legs 26 and 28 may be crimped or twisted together, or otherwise manipulated to keep adjacent panels mutually planar at the joint. As used herein and in the claims, the term "interlock" is used in its broadest possible sense.

It is understood that further variations in design of the panels, the anchorage and interlock features may be made without departing from the invention.

What is claimed is:

1. An interlocking corrugated panel for use in constructing a foundation wall above ground for a building wherein an elongated physical guide has been presupported along a line above ground at which the top of said foundation wall is to exist and wherein a plurality of said interlocking corrugated panels is attached to said elongated physical guide and the lower portion of said panels hang downwardly into a foundation support opening and a flowable hardenable building material is placed in said opening and around said lower portion of said panels, said panel comprising:

first and second corrugated panels each having a top, bottom and first and second edges, each of said panels having flutes extending from top to bottom, anchorage means carried at the bottom of each of said first and second panels, each of said anchorage means forming an angle with said first and second panels whereby said panels are straightened horizontally, and each of said anchorage means having end portions extending to said first and second edges of said panels, and anchorage interlock means formed in said anchorage end portions whereby the anchorage interlock means formed at the second edge of said first panel is interlockable with the anchorage interlock means formed at the first edge of said second panel.

2. The apparatus of claim 1 further comprising:

panel edge interlock means formed along said first and second edges of said panels whereby the panel edge interlock means formed along the second edge of said first panel is interlockable with the panel edge interlock means formed along the first edge of said second panel.

3. The apparatus of claim 1 wherein said fluted panel has flutes extending in an exterior direction and flutes extending in an interior direction and wherein said anchorage means comprises the bottom section of said corrugated fluted panel wherein flutes extending in said exterior direction have been cut or punched horizontally and the uncut flutes are bent in said interior direction.

4. The apparatus of claim 3 wherein said cut flutes of said anchorage means form anchoring tabs in the resulting foundation wall and wherein said uncut flutes of said anchorage means form bearing tabs in the resulting foundation wall.

5. The apparatus of claim 1 wherein said fluted panel has flutes extending in an exterior direction and flutes extending in an interior direction and wherein said anchorage means comprises the bottom section of said corrugated fluted panel wherein flutes extending in said interior direction have been cut or punched horizontally and the uncut flutes are bent in said exterior direction.

6. The apparatus of claim 1 wherein said fluted panel has flutes extending in an exterior direction and flutes extending in an interior direction and wherein each of said panels and each anchoring means connected thereto are formed from a single corrugated panel wherein flutes extending in said exterior direction are cut or punched along a bend line and flutes extending in said interior direction are bent along said bend line.

7. The apparatus of claim 6 wherein said flutes extending in said interior direction are bent in said interior direction.

8. The apparatus of claim 6 wherein said end portion of each anchorage means comprises one of said flutes extending in said exterior direction which has been cut or punched along said bend line and wherein said anchorage interlock means comprises said end portions of each anchorage means.

9. The apparatus of claim 8 wherein said end portions of each anchorage means are bent into either a male or female shape, with the male shape being applied to one edge of each panel and the female shape being applied to the other edge of each panel.

10. The apparatus of claim 1 wherein said fluted panel has flutes extending in an exterior direction and flutes extending in an interior direction and wherein each of said panels and each anchoring means connected thereto are formed from a single corrugated panel wherein flutes extending in said interior direction are cut or punched along a bend line and flutes extending in said exterior direction are bent along said bend line.

11. An apparatus for constructing a foundation wall for a building, where an elongate physical guide has been presupported along a line at a predetermined height above ground at which the top of said foundation wall is to be formed, said foundation wall to extend downward between said elongate physical guide means and the earth, the earth having been prepared for foundation support to achieve predetermined foundation design loads, including lateral loads and bearing loads, the foundation wall construction apparatus comprising in combination:

an elongate physical guide means presupported along a line at a predetermined height above ground at which the top of said foundation wall is to be formed, a panel body having a top, bottom and first and second edges, with flutes extending from top to bottom, anchorage means carried at the bottom of said panel body, said anchorage means forming an angle with said panel body and straightening said panel horizontally, and wherein said anchorage means comprises the bottom section of said corrugated fluted panel wherein flutes extending in one direction relative to said building have been cut or punched horizontally and the uncut flutes are bent in an opposite direction relative to said building.

12. An apparatus for constructing a foundation wall for a building, where an elongate physical guide has been presupported along a line at a predetermined height above ground at which the top of said foundation wall is to be formed, said foundation wall to extend downward between said elongate physical guide means and the earth, the earth having been prepared for foundation support to achieve predetermined foundation design loads, including lateral loads and bearing loads, the foundation wall construction apparatus comprising in combination:

an elongate physical guide means presupported along a line at a predetermined height above around at which the top of said foundation wall is to be formed, a panel body having a top, bottom and first and second edges, and anchorage means carried at the bottom of said panel body, said anchorage means formed from a portion of said panel body bottom and adapted to interact with concrete or other foundation support material and interlocking edge means carried at said first and second edges for interlocking with edges of adjacent panels.

* * * * *

UNITED STATES PATENT AND TRADEMARK OFFICE

CERTIFICATE OF CORRECTION

PATENT NO. : 6,205,725 B1
DATED : March 27, 2001
INVENTOR(S) : Michael Butler

It is certified that error appears in the above-identified patent and that said Letters Patent is hereby corrected as shown below:

The paragraph entitle "Related U.S. Application Data" on the cover sheet should be changed from:

(63) Continuation-in-part of application No. 08/871,395, filed on Jun. 9, 1997, now Pat. No. 6,076,320, which is a continua tion-in-part of application No. 08/818,497, filed on Mar. 14, 1997, now abandoned, which is a continuation-in-part of ap plication No. 08/600,408, filed on Feb. 12, 1996, now Pat. No. 5,830,378, which is a continuation-in-part of application No. 08/398,356, filed on Mar. 3, 1995, now abandoned, which is a continuation-in-part of application No. 08/299,474, filed on Aug. 29, 1994, now Pat. No. 5,564,235,

(60) Provisional application No. 60/067,741, filed on Dec. 2, 1997.

To

(63) Continuation-in-part of application No. 08/871,395, filed on Jun. 9, 1997, now Pat. No. 6,076,320, which is a continuation-in-part of application No. 08/818,497, filed on Mar. 14, 1997, now abandoned

(60) Provisional application No. 60/067,741, filed on Dec. 2, 1997.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*